US006971131B2

(12) United States Patent
Bannister

(10) Patent No.: US 6,971,131 B2
(45) Date of Patent: Dec. 6, 2005

(54) SURGICAL TABLES

(75) Inventor: Grahame David Bannister, Lindfield (GB)

(73) Assignee: Eschmann Holdings Limited, West Sussex (GB)

( * ) Notice: Subject to any disclaimer, the term of this patent is extended or adjusted under 35 U.S.C. 154(b) by 54 days.

(21) Appl. No.: 10/250,766

(22) PCT Filed: Jan. 11, 2002

(86) PCT No.: PCT/GB02/00117

§ 371 (c)(1),
(2), (4) Date: Nov. 24, 2003

(87) PCT Pub. No.: WO02/055001

PCT Pub. Date: Jul. 18, 2002

(65) Prior Publication Data

US 2004/0074003 A1 Apr. 22, 2004

(30) Foreign Application Priority Data

Jan. 13, 2001 (GB) ..... 0100981

(51) Int. Cl.[7] ..... A61G 13/00
(52) U.S. Cl. ..... 5/616; 5/618; 5/610
(58) Field of Search ..... 5/616–618, 613, 5/600, 610

(56) References Cited

U.S. PATENT DOCUMENTS

| | | | | |
|---|---|---|---|---|
| 3,635,461 | A * | 1/1972 | Bellucci et al. | 5/616 |
| 3,754,749 | A * | 8/1973 | Lyon et al. | 5/618 |
| 3,868,103 | A | 2/1975 | Pageot et al. | 5/614 |
| 3,980,288 | A * | 9/1976 | Mitchell et al. | 5/601 |
| 4,101,120 | A | 7/1978 | Seshima | 5/616 |
| 5,279,011 | A | 1/1994 | Schnelle | 5/616 |
| 5,643,180 | A * | 7/1997 | McIlwain | 601/24 |
| 5,659,909 | A * | 8/1997 | Pfeuffer et al. | 5/600 |
| 2004/0074003 | A1 * | 4/2004 | Bannister | 5/616 |

FOREIGN PATENT DOCUMENTS

| | | |
|---|---|---|
| EP | 0691119 | 1/1996 |
| FR | 2683995 | 5/1993 |
| WO | 99/25303 | 5/1999 |

* cited by examiner

*Primary Examiner*—Robert G. Santos
(74) *Attorney, Agent, or Firm*—Louis Woo

(57) ABSTRACT

A surgical table having a patient support member mounted at the upper end of a column, the support member having at least two sections along its length, the two sections being mounted with one another on opposite sides of the table by respective gear means, each gear means including respective drive means for rotating the gear means about a common transverse axis, and the table including means for controlling operation of the two drive means so that they rotate the respective gear means through the same angle.

14 Claims, 4 Drawing Sheets

SURGICAL TABLES

This invention relates to surgical tables.

Surgical tables usually have a patient support mounted at the upper end of a column, the height of which can be adjusted. The table is usually capable of adjusting the angle of the support both about a longitudinal axis and about a transverse axis. The support is usually divided into a number of different sections, such as a head section, a torso section and a leg section. The torso section is usually divided into two parts the angle of which can be adjusted relative to one another about a transverse axis. In most cases, the different sections are connected with the column or with other sections by struts the length of which can be adjusted so that the angle of the sections can be adjusted. These struts may be hydraulic actuators or electrically-driven screw actuators. The problem with these previous tables is that it can be difficult to displace the sections through large angles from aligned position. For some surgical procedures it can be preferable to be able to bend the lower torso section relative to the upper torso section between as much as an angle of 90° up and an angle of 50° down, that is, the lower section needs to be capable of being moved through an angle of 140°.

It is an object of the present invention to provide an alternative surgical table.

According to one aspect of the present invention there is provided a surgical table having a patient support member mounted at the upper end of a column, the support member having at least two sections along its length, the two sections being mounted with one another on opposite sides of the table by respective gear means, each gear means including respective drive means for rotating the gear means about a common transverse axis, and the table including means for controlling operation of the two drive means so that they rotate the respective gear means through the same angle.

Each drive means preferably includes an electric motor. The means for controlling operation of the drive means preferably includes a sensor, such as an optical sensor, responsive to rotation of the gear means.

A surgical table according to the present invention, will now be described, by way of example, with reference to the accompanying drawings, in which.

Figure 1:
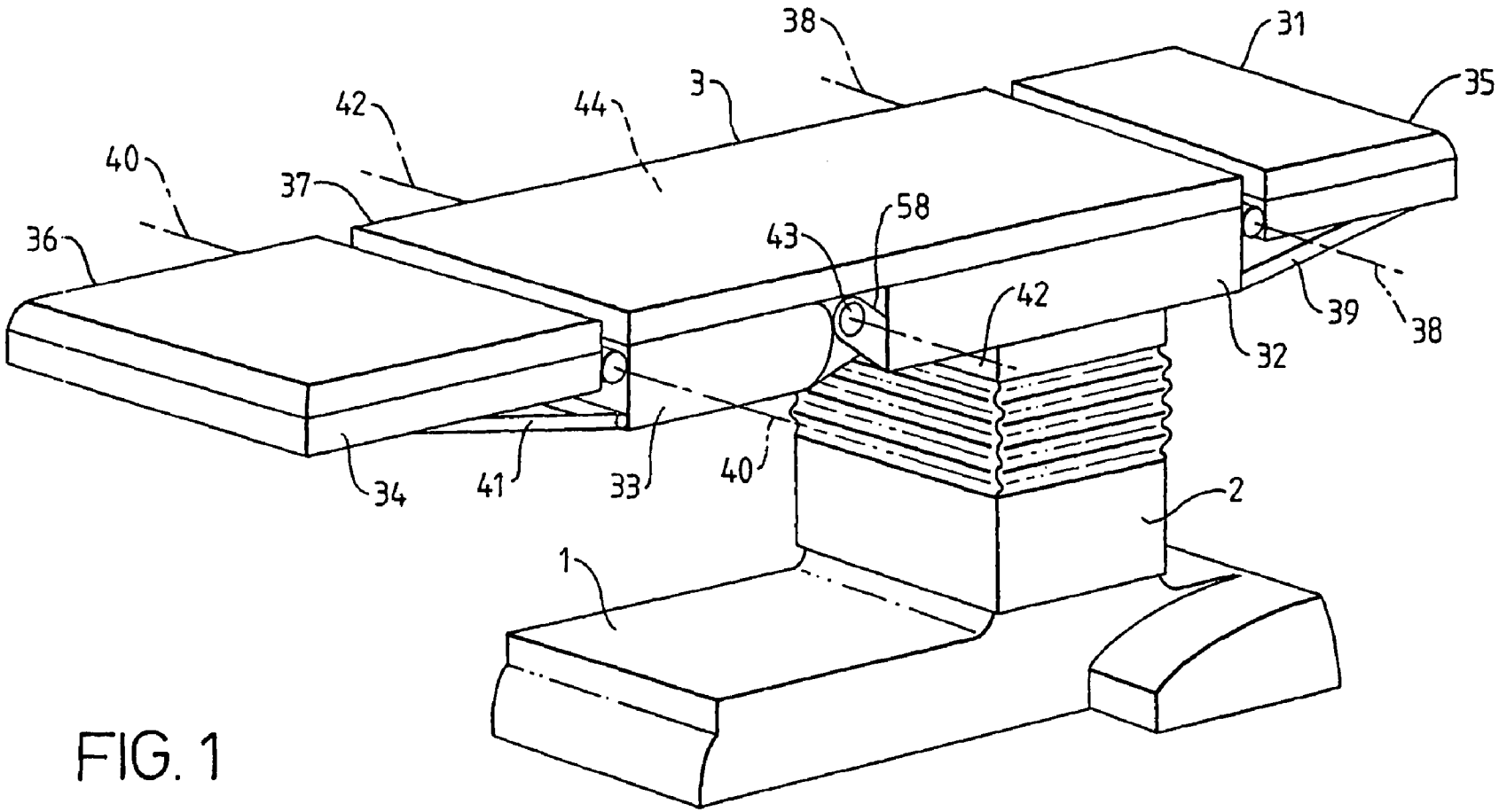
FIG. 1 is a perspective view of the table.

With reference first to FIG. 1, the table includes a base 1, which stands on the floor, a column 2 of adjustable height mounted on the base and a table top 3 providing a patient support surface 4.

The table top 3 is divided into four sections, namely a head section 31, an upper torso section 32, a lower torso section 33 and a leg section 34. The head and leg sections 31 and 34 each have a separate mattress 35 and 36, whereas the two torso sections 32 and 33 have common mattress 37 extending along the length of both sections. The lower end of the head section 31 is mounted on the upper end of the upper torso section 32 by means of a conventional pivot joint so that it can be displaced about a transverse axis 38. The angle of the head section 31 is controlled by means of a pair of conventional adjustable struts 39, only one of which is shown, extending between the underside of the head section and the upper torso section 32, one on each side. The struts may be hydraulic or electric actuators. The leg section 34 is similarly mounted at the lower end of the lower torso section 33 for displacement about a transverse axis 40 by means of two struts 41 secured at opposite ends to the two sections.

Figure 2:
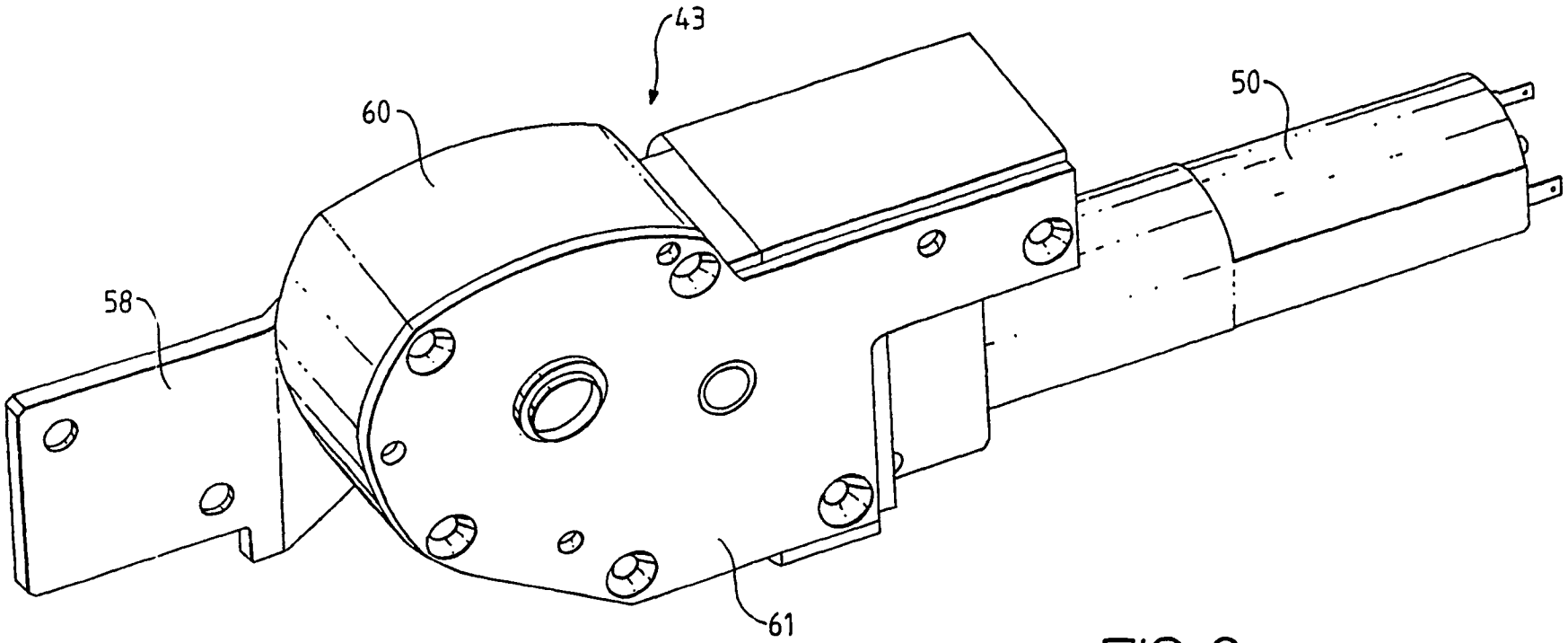
FIG. 2 is a perspective view of a coupling between two sections of the table top.
Figure 3:
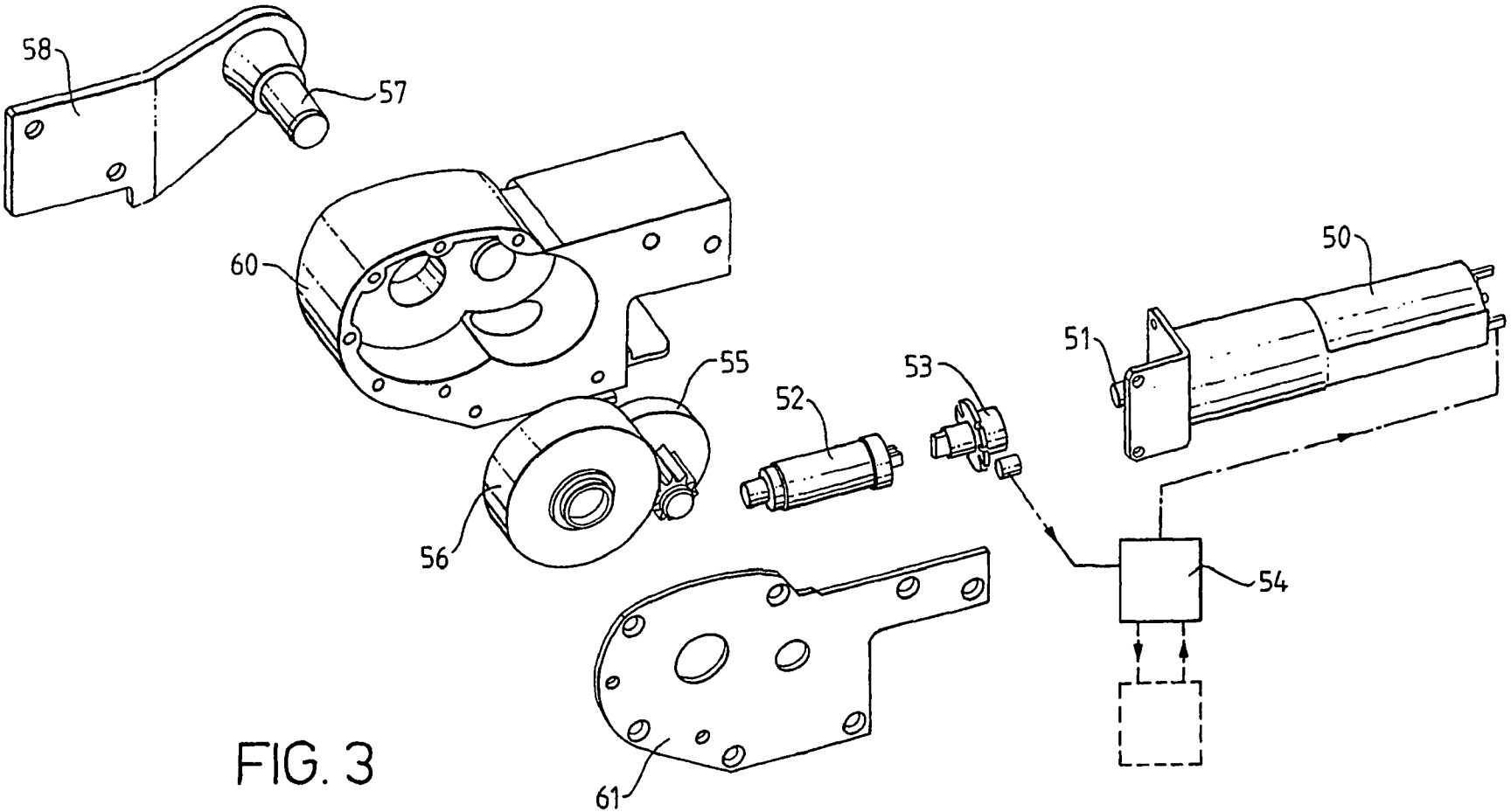
FIG. 3 is an exploded view of the coupling shown in FIG. 2.

The lower torso section 33 can also be displaced relative to the upper torso section 32 about a transverse axis 42 by means of two electrically-driven rotary gear mechanisms 43 and 44 on opposite sides of the table. The two gear mechanisms 43 and 44 have the same construction as one another except that one is a mirror image of the other so only one mechanism 43 will be described, with reference to FIGS. 2 and 3. The mechanism 43 includes an electric motor 50 arranged substantially longitudinally of the table and having its output shaft 51 connected to a worm gear 52 via an optical pick-off 53, which provides an output to a control unit 54 representative of the speed and extent of rotation of the motor shaft. The worm gear 52 meshes with the edge of a reduction gear 55 arranged for rotation about a transverse axis. The reduction gear 55 meshes with the edge of a main gear wheel 56, which is fixed on a stub 57 projecting from the inside surface of a side plate 58 so that the gear wheel and stub rotate together. The side plate 58 is attached with the side of the upper torso section 32. The gears 52, 55 and 56, and the pick-off 53 are mounted in a gear mechanism housing 60 having a side plate 61. The motor 50 is secured on this housing 60 and projects therefrom. The housing 60 is secured with the side of the lower torso section 33.

It can be seen that, as the motor 50 is rotated it rotates the worm gear 52 and that this in turn rotates the reduction gear 55. Typically, about 38 rotations of the motor 50 are required to rotate the reduction gear 55 through one complete revolution. The reduction gear 55 in turn rotates the main gear wheel 56. Typically, about 3.8 rotations of the reduction gear 55, that is, 144.4 rotations of the motor 50, are required to rotate the main gear wheel 56 through one complete revolution. The gear mechanism 43 is arranged such that the main gear wheel 56 is rotatable through an angle of about 140°, so that the lower torso section 33 can be raised through an angle of up to 90° above the upper torso section 32 and can be lowered through an angle of up to 50° below the upper torso section.

The motor in the gear mechanism 44 on the opposite side of the table is driven in the opposite sense to produce the same rotation of the gear mechanism. This is achieved by the control unit 54, which compares the pick-off outputs from the two gear mechanisms 43 and 44 and alters power supply to one or both motors accordingly to produce rotation of the two gear mechanisms through the same angle.

Figure 4:
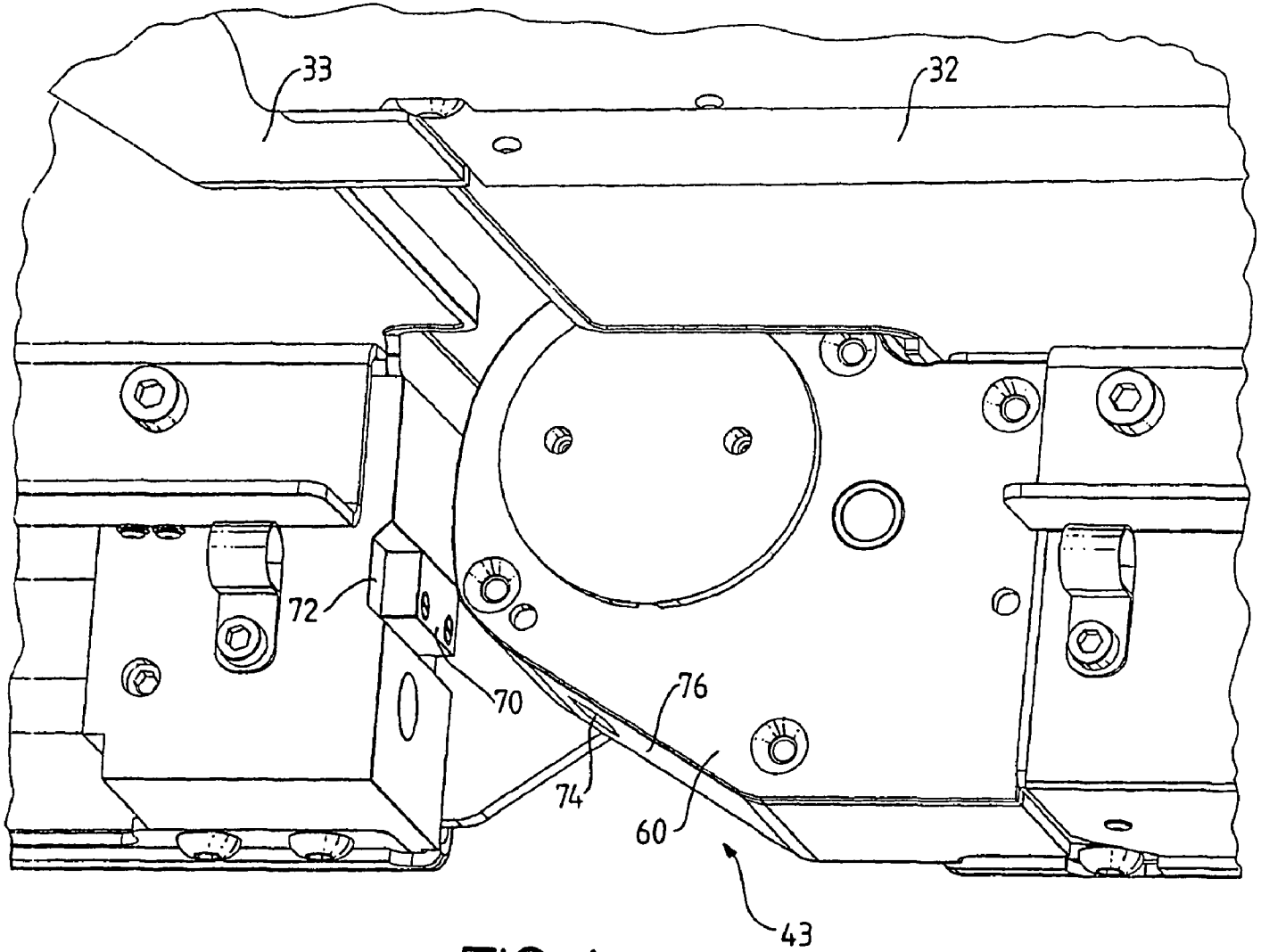
FIG. 4 is a perspective view from below of an inner side of one of the couplings of FIG. 3.

Referring to FIG. 4, the gear mechanism 43 is further provided with a sensor which is used to provide a calibration reference point for the angular position of the gear mechanism 43, and correspondingly the relative angular positions of the lower torso section 33 and the upper torso section 32. The sensor, which may be a contact or a non-contact sensor, comprises in the illustrated embodiment a reed switch 70 which is mounted on an end 72 of the lower torso section 33, in combination with an actuator for the reed switch 70, which actuator comprises a magnet 74 disposed on or recessed in an outer surface 76 of the gear mechanism housing 60, the housing 66 in turn being mounted on the upper torso section 32. The reed switch 70 is triggered when the magnet 74 passes thereby, in this way providing a signal corresponding to a calibration reference point for the angular position of the sections 33,32. The calibration reference point may also be used in combination with the control unit to provide diagnostic information as to the calibration status. In the illustrated embodiment, the sensor comprises a reed switch, but alternatively may comprise a microswitch or an optical device, thereby being a contact or non-contact sensor.

In a further embodiment, the drive means, comprising the electric motor 50, may include a tachometer, which typically may comprise a Hall effect device, which is adapted to count the number of rotations of the motor, thereby to provide additional positional and speed feedback information to the control unit. This provides enhanced accuracy of the positional control of the sections of the table.

The arrangement of the present invention enables relatively large relative movements between two sections of a surgical table. It also has the advantage of being relatively compact and of not obstructing space beneath the table, under the patient. This can be an advantage if access is required by imaging equipment.

The gear mechanisms of the present invention need not be driven by electric motors but could be driven, for example, by hydraulic motors.

What is claimed is:

1. A surgical table having a patient support member mounted at the upper end of a column, the support member having at least two sections along its length, the at least two sections being mounted with one another on opposite sides of the table by respective gear means, each gear means including respective drive means for rotating the gear means about a common transverse axis, and the table including means for controlling operation of the drive means so that they rotate the respective gear means through the same angle, wherein the at least two sections comprise a lower torso section and an upper torso section of the surgical table and wherein the gear means is arranged so that the lower and upper torso sections can be relatively rotated through an angle of about 140°.

2. A surgical table according to claim 1 wherein each drive means includes an electric motor.

3. A surgical table according to claim 2 wherein each electric motor is arranged substantially longitudinally of the table and has an output shaft connected to a worm gear which meshes with an edge of a respective reduction gear arranged for rotation about the common transverse axis.

4. A surgical table according to claim 3 wherein the reduction gear meshes with an edge of a main gear wheel which is fixed on a stub, against relative rotational movement therebetween, projecting from a side plate attached to one of the at least two sections.

5. A surgical table according to claim 4 wherein the worm gear, the reduction and the main gear wheel are mounted in a gear mechanism housing secured to the other of the at least two sections.

6. A surgical table according to claim 5 wherein the electric motor is secured to the housing and projects therefrom.

7. A surgical table according to any foregoing claim wherein the means for controlling operation of the drive means includes a sensor responsive to rotation of the gear means.

8. A surgical table according to claim 7 wherein the sensor is an optical sensor.

9. A surgical table according to claim 5, further comprising an optical sensor responsive to rotation of the gear means, wherein the optical sensor is mounted in the gear mechanism housing.

10. A surgical table according to claim 1 wherein the gear means is arranged so that the lower torso section can be raised through an angle of up to 90° above the upper torso section and can be lowered through an angle of up to 50° below the upper torso section.

11. A surgical table according to any of claims 1 to 6 wherein the means for controlling includes a control unit which compares the positions of the gear means and alters power supply to one or both drive means accordingly to produce rotation of the two gear means through the same angle.

12. A surgical table according to any of claims 1 to 6 wherein the gear means includes a sensor to provide a signal corresponding to a calibration reference point for the relative angular positions of the sections.

13. A surgical table according to claim 12 in which the control unit is further adapted to process the signal corresponding to the calibration reference point thereby to provide diagnostic information as to the calibration status.

14. A surgical table according to any of claims 1 to 6 wherein the drive means includes a tachometer to provide additional position and speed feedback to the control system.

* * * * *